US009689651B1

(12) United States Patent
Lee

(10) Patent No.: US 9,689,651 B1
(45) Date of Patent: Jun. 27, 2017

(54) REMOVABLE ONE PIECE FOLDING PRIMER FEEDING TRAY

(71) Applicant: John D. Lee, Hartford, WI (US)

(72) Inventor: John D. Lee, Hartford, WI (US)

( * ) Notice: Subject to any disclaimer, the term of this patent is extended or adjusted under 35 U.S.C. 154(b) by 0 days.

(21) Appl. No.: 15/071,315

(22) Filed: Mar. 16, 2016

(51) Int. Cl.
*F42B 33/00* (2006.01)
*F42B 33/04* (2006.01)

(52) U.S. Cl.
CPC ..... *F42B 33/002* (2013.01); *F42B 33/001* (2013.01); *F42B 33/04* (2013.01)

(58) Field of Classification Search
CPC ..... F42B 33/002; F42B 33/04; F42B 33/001; B23P 19/004
See application file for complete search history.

(56) References Cited

U.S. PATENT DOCUMENTS 2,596,958 A * 5/1952 Phelps ..... B23P 19/004 221/160
4,154,340 A * 5/1979 Beebe ..... F42B 33/002 206/305
4,222,305 A * 9/1980 Lee ..... F42B 33/04 86/37
5,435,223 A * 7/1995 Blodgett ..... F42B 33/04 86/38
7,806,034 B1 * 10/2010 Lee ..... F42B 33/001 86/37
7,836,922 B2 * 11/2010 Poole ..... B65B 1/12 141/12
2010/0101401 A1 * 4/2010 Toeckes ..... A62C 3/08 89/1.51

* cited by examiner

*Primary Examiner* — Stephen M Johnson
*Assistant Examiner* — Joshua Semick
(74) *Attorney, Agent, or Firm* — Donald J. Ersler

(57) ABSTRACT

A removable one piece folding primer feeding tray preferably includes a feed tray and a valve switch. The feed tray includes a tray portion, a cover portion and a feed channel. A tray edge of the tray portion is preferably pivotally connected to the cover portion. The cover portion includes two opposing cover side walls, which are spaced apart to receive an outside perimeter of the two opposing tray side walls. The feed channel extends from an opposing edge of the tray portion. The valve switch is slidably engaged with the feed tray. The valve switch controls the flow of primers and locks the cover portion to the tray portion. A feed adapter is retained in a hand held or bench mounted primer actuator and receives the primers from the removable folding primer tray and the lifts primers for pressing into a cartridge.

15 Claims, 8 Drawing Sheets

REMOVABLE ONE PIECE FOLDING PRIMER FEEDING TRAY

BACKGROUND OF THE INVENTION

1. Field of the Invention

The present invention relates generally to reloading ammunition and more specifically to a removable one piece folding primer feeding tray, which includes a top accessible dispensing valve for controlling the flow of primers to a primer actuation device.

2. Discussion of the Prior Art

U.S. Pat. No. 4,222,305 to Lee discloses a tool for installing primers in ammunition cartridges. The Lee '305 patent includes an elongated body, a carrier element engageable with the body, a primer cap driving pin slidable in the cartridge element, a shell holder support in the body, a hand operating lever and a toggle link pivotal retained on the hand operating lever. U.S. Pat. No. 5,435,223 to Blodgett et al. discloses a cartridge priming device with safety guard. The Blodgett et al. includes a primer receiving station for holding a single primer for insertion into a cartridge, a primer reservoir operable to hold a plurality of primers, a primer passage for directing primers from the reservoir to the primer receiving station and a guard shiftable to protect the primer passage. U.S. Pat. No. 7,806,034 to Lee et al. discloses a safety prime feeding device. The Lee et al. patent includes a tray base, a tray cover, a bearing yoke, a priming pin and an elevator pin. U.S. Pat. No. 7,806,034 is hereby incorporated by reference in its entirety into this patent application.

Accordingly, there is a clearly felt need in the art for a removable one piece folding primer feeding tray, which includes a plurality of viewing windows to determine the amount of primers being fed; and a top accessible dispensing valve for controlling the flow of primers to a primer actuation device.

SUMMARY OF THE INVENTION

The present invention provides a removable one piece folding primer feeding tray, which includes a plurality of viewing windows to determine the amount of primers being fed. The removable one piece folding primer feeding tray (removable folding primer tray) preferably includes a feed tray and a valve switch. The feed tray includes a tray portion, a cover portion and a feed channel. The tray portion and the cover portion each preferably have a substantially triangular shape. A tray edge of the tray portion is preferably pivotally engaged with the cover portion with a double living hinge. However, other types of hinge designs may also be used. The double living hinge includes a plurality of first bend tabs, a lengthwise strip and a plurality of second bend tabs. The first plurality of bend tabs extend from a first side of the lengthwise strip and the second plurality of bend tabs extend from a second side of the lengthwise strip. The plurality of first bend tabs are engaged with an edge of the tray portion and the plurality of second bend tabs are engaged with an edge of the cover portion. The tray portion includes two opposing tray side walls. The cover portion includes two opposing cover side walls, which are spaced apart to receive an outside perimeter of the two opposing tray side walls.

The feed channel extends from an opposing edge of the tray portion. An inner perimeter of the feed channel communicates with the tray portion to receive a plurality of primers from the tray portion. A plurality of concentric circular projections preferably extend upward from the tray portion. A portion of some of the plurality of concentric circular projections are interrupted by a plurality of parallel channels. A height of the concentric circular projections is less than a fifth of a height of a thickness of a primer. A plurality of sight windows are formed through the cover portion adjacent the feed channel to show the number primers that are ready to be fed into the feed channel. The feed tray may be fabricated from a translucent or opaque material.

The valve switch preferably includes a tray sliding retainer, a base portion and a cover sliding retainer. The tray sliding retainer extends downward from a bottom of the base portion and the cover sliding retainer extends upward from a top of the base portion. The base portion preferably includes a substantially elliptical shaped perimeter. The tray sliding retainer preferably includes a pair of opposing snaps, which engage a bottom of the tray portion. The cover sliding retainer preferably includes a pedestal and a slide tab. A switch slot is formed through the tray portion, adjacent the feed channel to receive the pair of opposing snaps. A bottom of the pedestal extends from the base portion and the slide tab extends upward from a top of the pedestal. A retainer slot is formed through the cover portion, adjacent the feed channel. The retainer slot includes an open slot and a lock slot that extends from the open slot. The open slot includes a width, which is sized to receive a width of the slide tab. The lock slot includes a width, which is sized to receive a width of the pedestal. The width of the slide tab is greater than a width of the lock slot. The valve switch preferably includes an open position, a locked position and a feed position. When the valve switch is in the open position, the cover portion may be raised. When the valve switch is in the locked position, the cover portion may not be raised, but the primers cannot be dispensed from the feed tray. When the valve switch is in the on position, the cover portion may not be raised and the primers can be dispensed from the feed tray.

A feed adapter is retained in a primer actuator and receives the primers from the removable folding primer tray and the lifts primers for pressing into a cartridge. The feed adapter preferably includes a first shell half, a second shell half, a primer press device and a feed elevator. The first and second shell halves preferably include a press pin channel, a vertical elevator slot and a feed channel receiver. One side of the first and second shell halves are pivotally engaged with each other and the feed channel receiver extends from an opposing side of the first and second shell halves. At least one fastener is used to secure the first and second shell halves to each other on the opposing side. The vertical elevator slot is located, adjacent the press pin channel. The feed channel receiver extends outward from a top of the vertical elevator slot. A portion of the primer press device is retained in the press pin channel and a projection slot.

The primer press device preferably includes an anvil base, a press pin, a press pin return spring and a sliding blast door. The anvil base includes an anvil portion and an elevator projection. A press pin bore is formed in a top of the anvil portion for retention of the press pin. An inner perimeter of the press pin return spring is retained on the press pin. The elevator projection extends from a side of the anvil portion. The sliding blast door includes a lengthwise slot formed through substantially all of a length of thereof. A top of the sliding blast door covers an open portion of the primer actuator, when the primer is elevated to for pressing into a shell. The elevator projection is inserted through a bottom of the lengthwise slot. A blast door compression spring is compressed and inserted between the elevator projection and a top of the lengthwise slot. The feed elevator is slidably retained in the vertical elevator slot. The feed elevator includes an elongated plate. An elevator projection slot is formed through one end of the elongated plate and a primer slot is formed through an opposing end of thereof. The feed elevator is sized for inserting different sized primers. The elevator projection is sized to receive the elevator projection of the anvil portion. The primer slot is sized to receive a primer dispensed from the removable folding primer tray.

The primer actuator may be hand held or bench mounted. Lee Precision of Hartford, Wis. manufacturers a suitable hand held primer actuator, under the product names of Auto Prime XR and Lee Ergo Prime. The bench mounted primer actuator is sold under a product name of Auto Bench Prime.

Accordingly, it is an object of the present invention to provide a removable folding primer tray, which includes a plurality of viewing windows to determine the amount of primers being fed.

Finally, it is another object of the present invention to provide a removable folding primer tray, which includes a top accessible dispensing valve for controlling the flow of primers to a primer actuation device.

These and additional objects, advantages, features and benefits of the present invention will become apparent from the following specification.

DETAILED DESCRIPTION OF THE PREFERRED EMBODIMENTS

Figure 1:
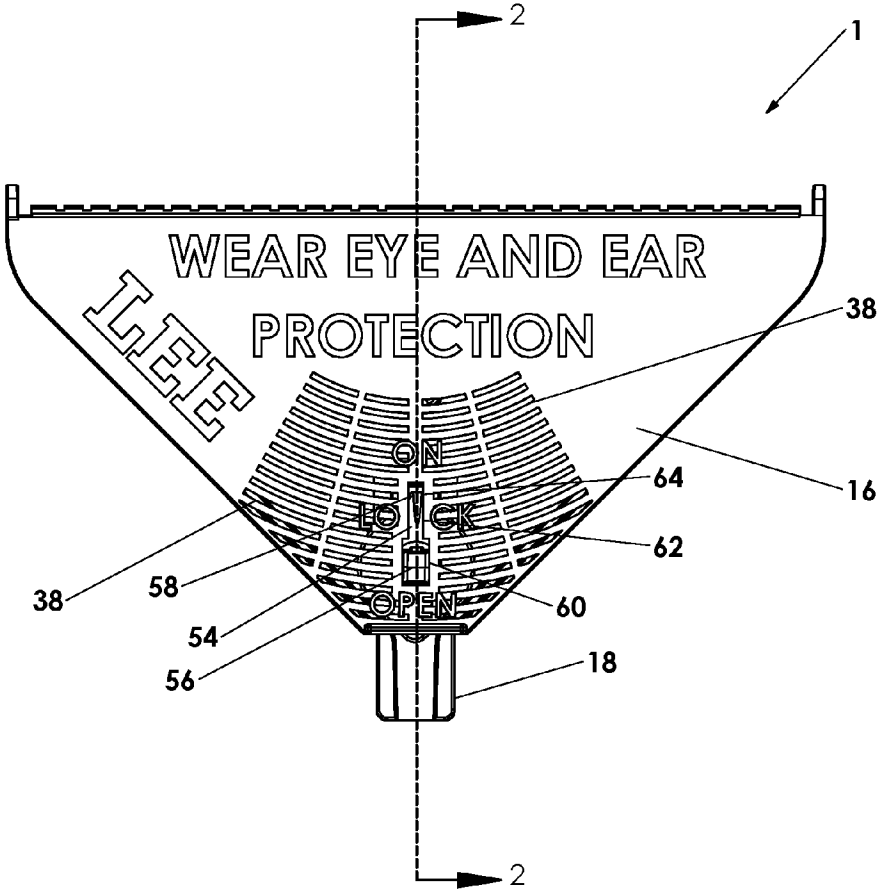
FIG. 1 is a top view of a closed removable folding primer tray in accordance with the present invention.
Figure 2:
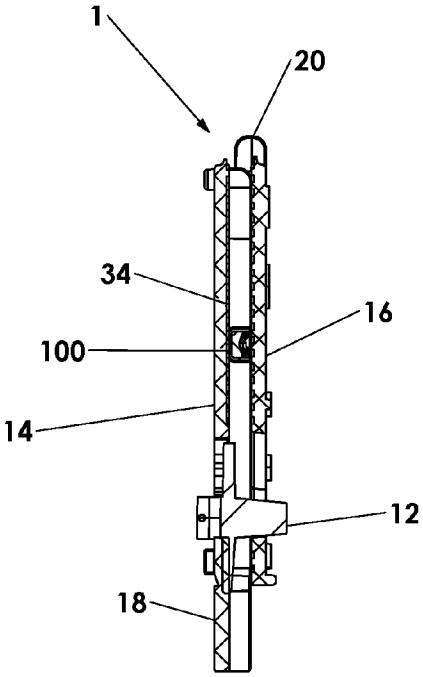
FIG. 2 is a cross sectional view of a closed removable folding primer tray in accordance with the present invention.
Figure 3:
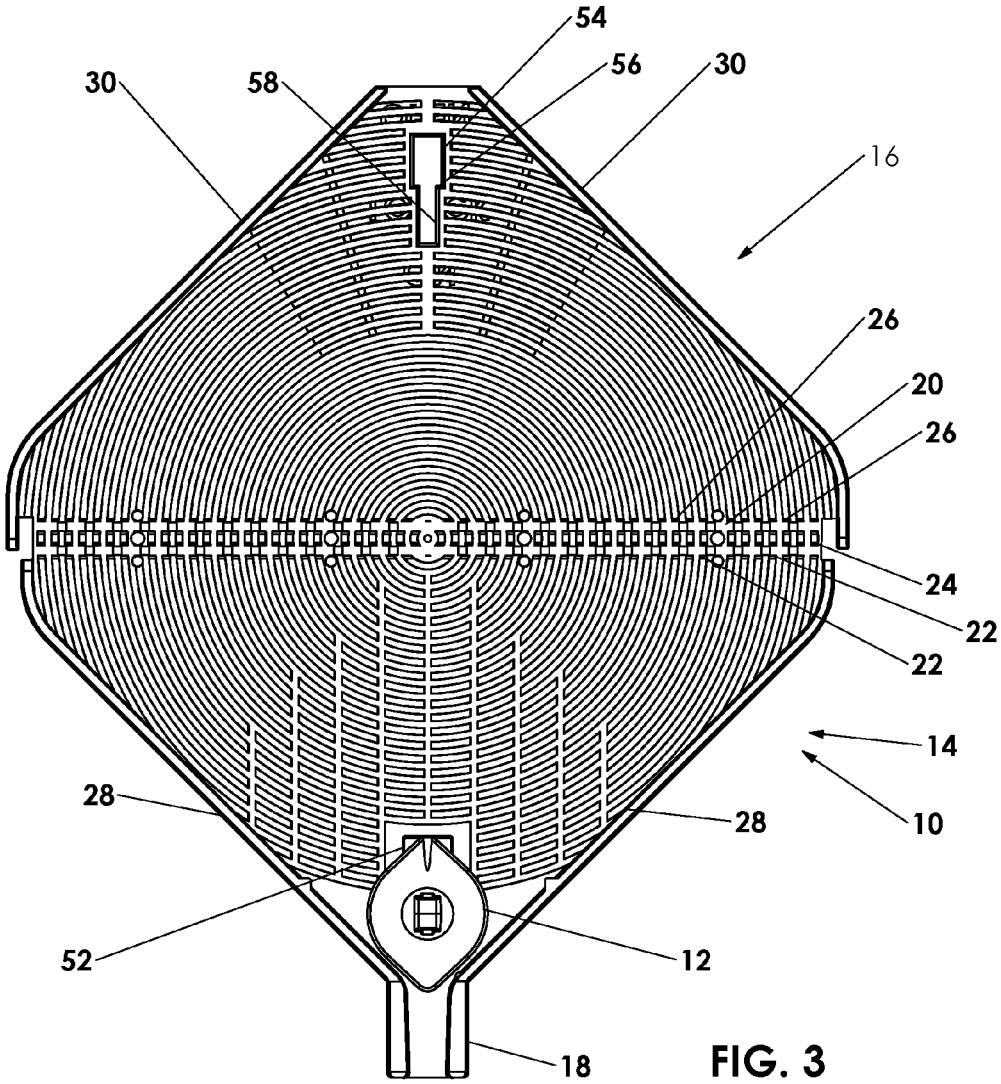
FIG. 3 is a top view of an open removable folding primer tray in accordance with the present invention.
Figure 4:
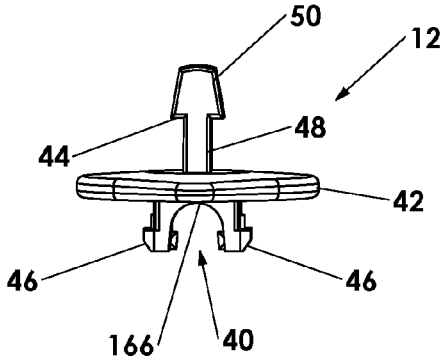
FIG. 4 is an enlarged front view of a valve switch of a of a removable folding primer tray in accordance with the present invention.

With reference now to the drawings, and particularly to FIG. 1, there is shown a top view of a closed removable folding primer tray 1. With reference to FIGS. 2-4, the removable folding primer tray 1 preferably includes a feed tray 10 and a valve switch 12. The feed tray 10 includes a tray portion 14, a cover portion 16 and a feed channel 18. The tray portion 14 and the cover portion 16 each preferably have a substantially triangular shape. A tray edge of the tray portion 14 is preferably pivotally engaged with the cover portion 16 with a double living hinge 20. However, other types of hinge designs may also be used. The double living hinge 20 includes a plurality of first bend tabs 22, a lengthwise strip 24 and a plurality of second bend tabs 26. The first plurality of bend tabs 22 extend from a first side of the lengthwise strip 24 and the second plurality of bend tabs 26 extend from a second side of the lengthwise strip 24. The plurality of first bend tabs 22 are engaged with an edge of the tray portion 14 and the plurality of second bend tabs are 26 engaged with an edge of the cover portion 16. The tray portion 14 includes two opposing tray side walls 28. The cover portion 16 includes two opposing cover side walls 30, which are spaced apart to receive an outside perimeter of the two opposing tray side walls 28. A tray inner perimeter created by said two opposing tray side walls 28 and said two opposing cover side walls 30 is sized to receive an outer perimeter of a box of primers.

Figure 5:
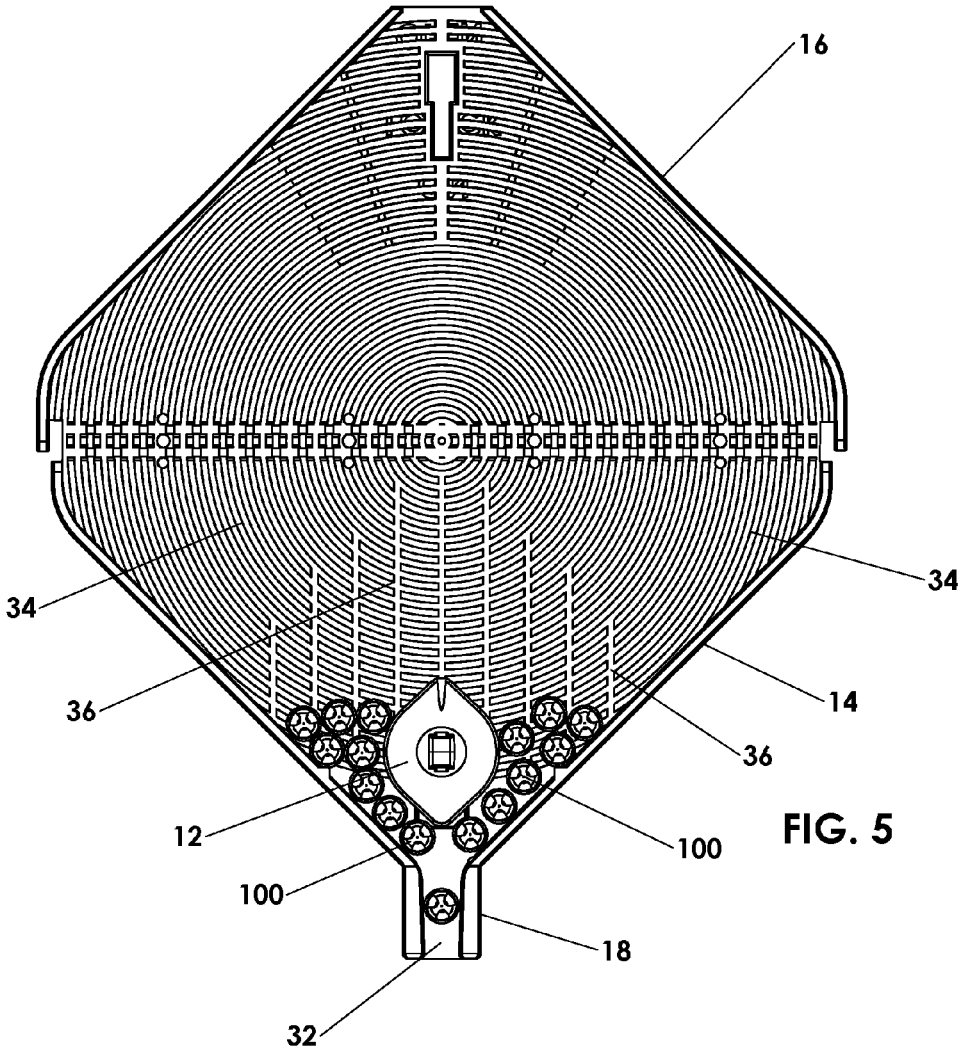
FIG. 5 is a top view of an open removable folding primer tray a valve switch in an on position and with a plurality of primers in the tray portion in accordance with the present invention.
Figure 6:
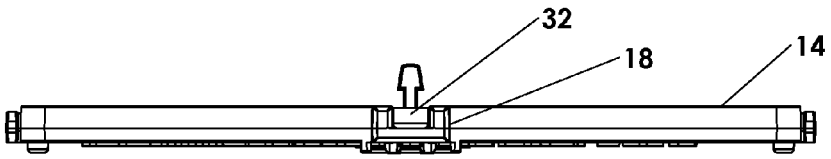
FIG. 6 is an end view of a feed channel of an open removable folding primer tray in accordance with the present invention.

With reference to FIGS. 5-6, the feed channel 18 extends from an opposing edge of the tray portion 14. A dispensing slot 32 of the feed channel 18 communicates with the tray portion 14 to receive a plurality of primers 100 from the tray portion 14. A plurality of concentric circular projections 34 preferably extend upward from a top of the tray portion 14. A portion of some of the plurality of concentric circular projections 34 are interrupted by a plurality of parallel channels 36. A height of the concentric circular projections 34 is less than a fifth of a height of a thickness of the primer 100. The purpose of the plurality of concentric circular projections 34 is to orient a bottom of a plurality of primers to be in contact with a top surface of the tray portion 14 by gently shaking the removable folding primer tray 1. With reference to FIG. 1, a plurality of sight windows 38 are formed through the cover portion 16 adjacent the feed channel to show the number primers 100 that are ready to be fed into the dispensing slot 32.

With reference to FIG. 4, the valve switch 12 preferably includes a tray sliding retainer 40, a base portion 42 and a cover sliding retainer 44. The tray sliding retainer 40 extends downward from a bottom of the base portion 42 and the cover sliding retainer 44 extends upward from a top of the base portion 42. The base portion 42 preferably includes a substantially elliptical shaped perimeter. The tray sliding retainer 40 preferably includes a pair of opposing snaps 46, which engage a bottom of the tray portion 14. The cover sliding retainer 42 preferably includes a pedestal 48 and a slide tab 50. A switch slot 52 is formed through the tray portion 14, adjacent the feed channel 18 to receive the pair of opposing snaps 46. A bottom of the pedestal 48 extends from a top of the base portion 42 and the slide tab 50 extends upward from a top of the pedestal 48. A retainer slot 54 is formed through the cover portion 16, adjacent an opposing edge of the cover portion 16. The retainer slot 54 includes an open slot 56 and a lock slot 58 that extends from the open slot 56. The open slot 56 includes a width, which is sized to receive a width of the slide tab 50. The lock slot 58 includes a width, which is sized to receive a width of the pedestal 48. The width of the slide tab 50 is greater than a width of the lock slot 58. The valve switch 12 preferably includes an open position 60, a locked position 62 and an "on" position 64. When the valve switch 12 is in the open position 60, the cover portion 16 may be raised. When the valve switch 12 is in the locked position 62, the cover portion 16 may not be raised, but the primers 100 cannot be dispensed from the feed tray 14. When the valve switch 12 is in the "on" position 64, the cover portion 16 may not be raised and the primers 100 can be dispensed from the feed tray as shown in FIG. 5.

Figure 7:
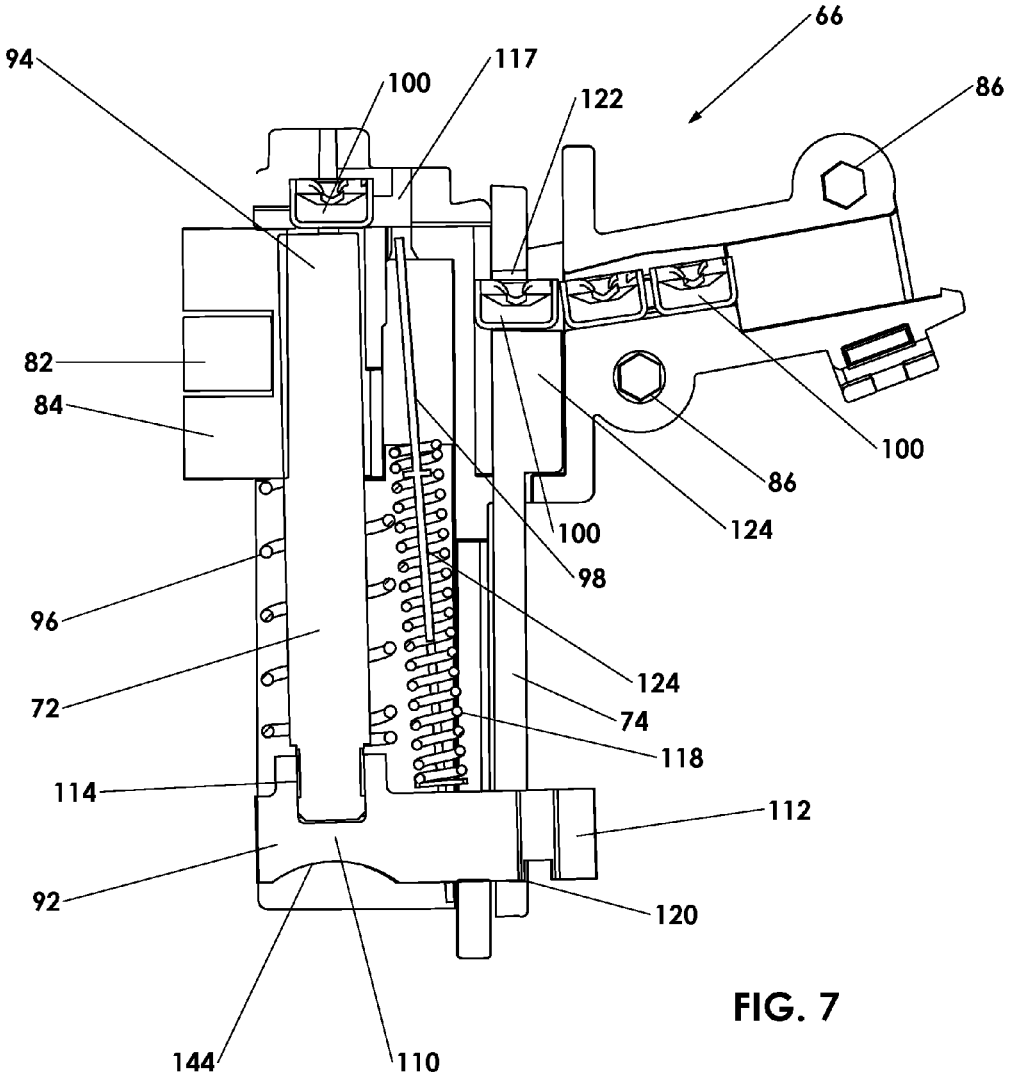
FIG. 7 is a cross sectional view of a feed adapter of for use with a removable folding primer tray with two primers retained therein in accordance with the present invention.
Figure 8:
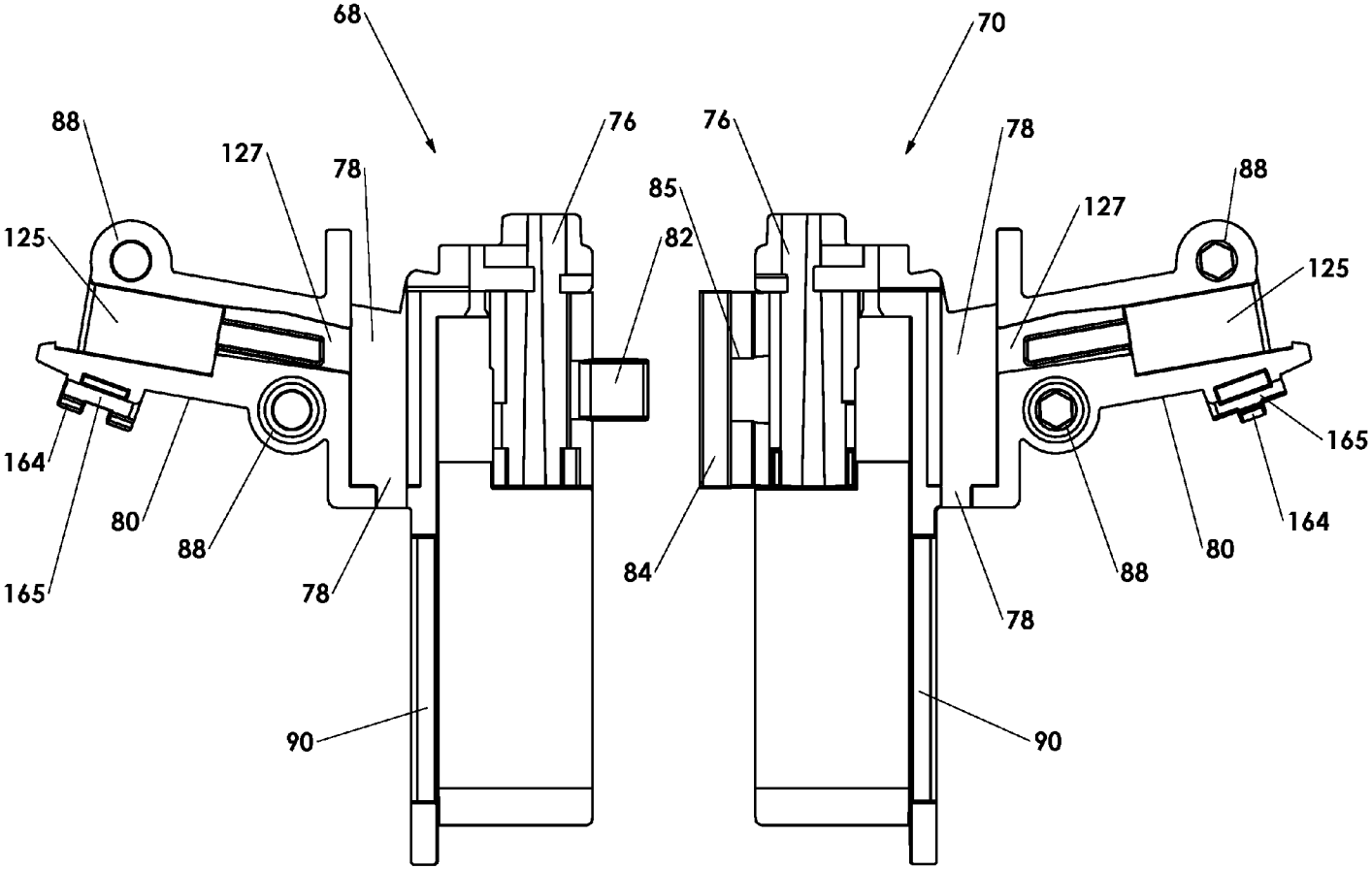
FIG. 8 is an inside front view of first shell half and a second shell half of a feed adapter for use with a removable folding primer tray in accordance with the present invention.
Figure 10:
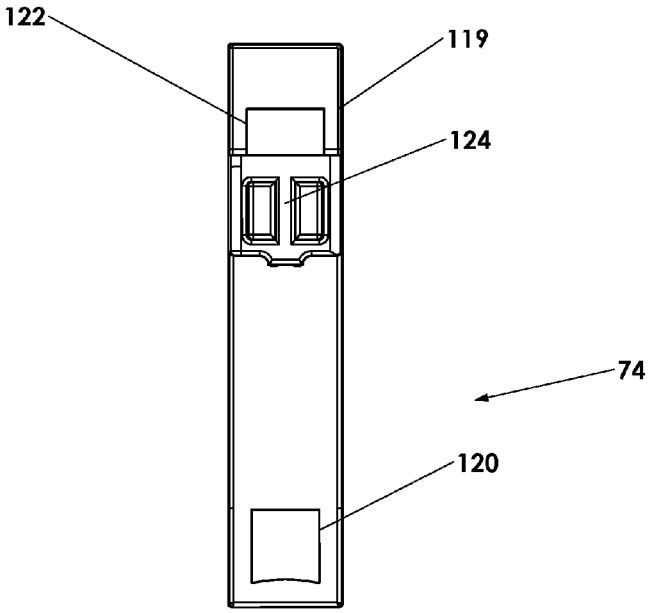
FIG. 10 is a front view of a feed elevator of a removable folding primer tray in accordance with the present invention.
Figure 12:
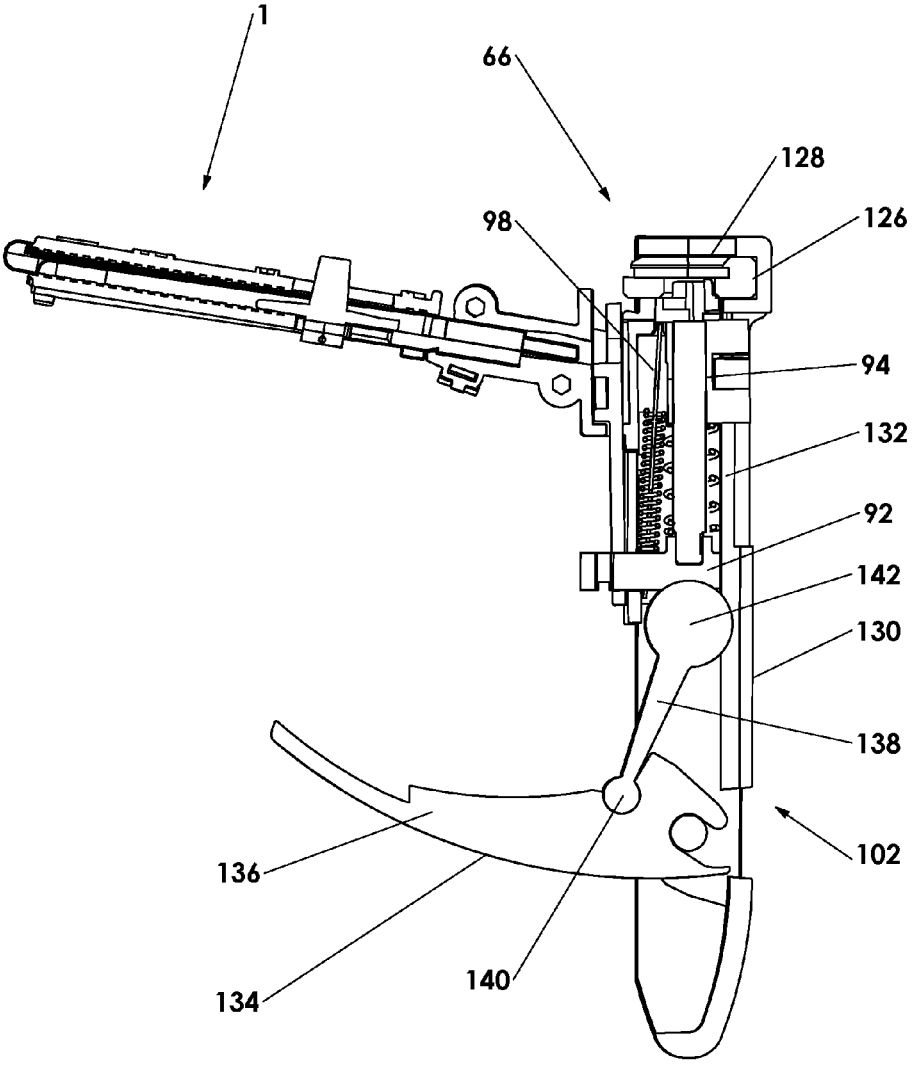
FIG. 12 is a cross sectional view of a removable folding primer tray retained in a feed adapter and the feed adapter retained in a hand held primer actuator in accordance with the present invention.
Figure 13:
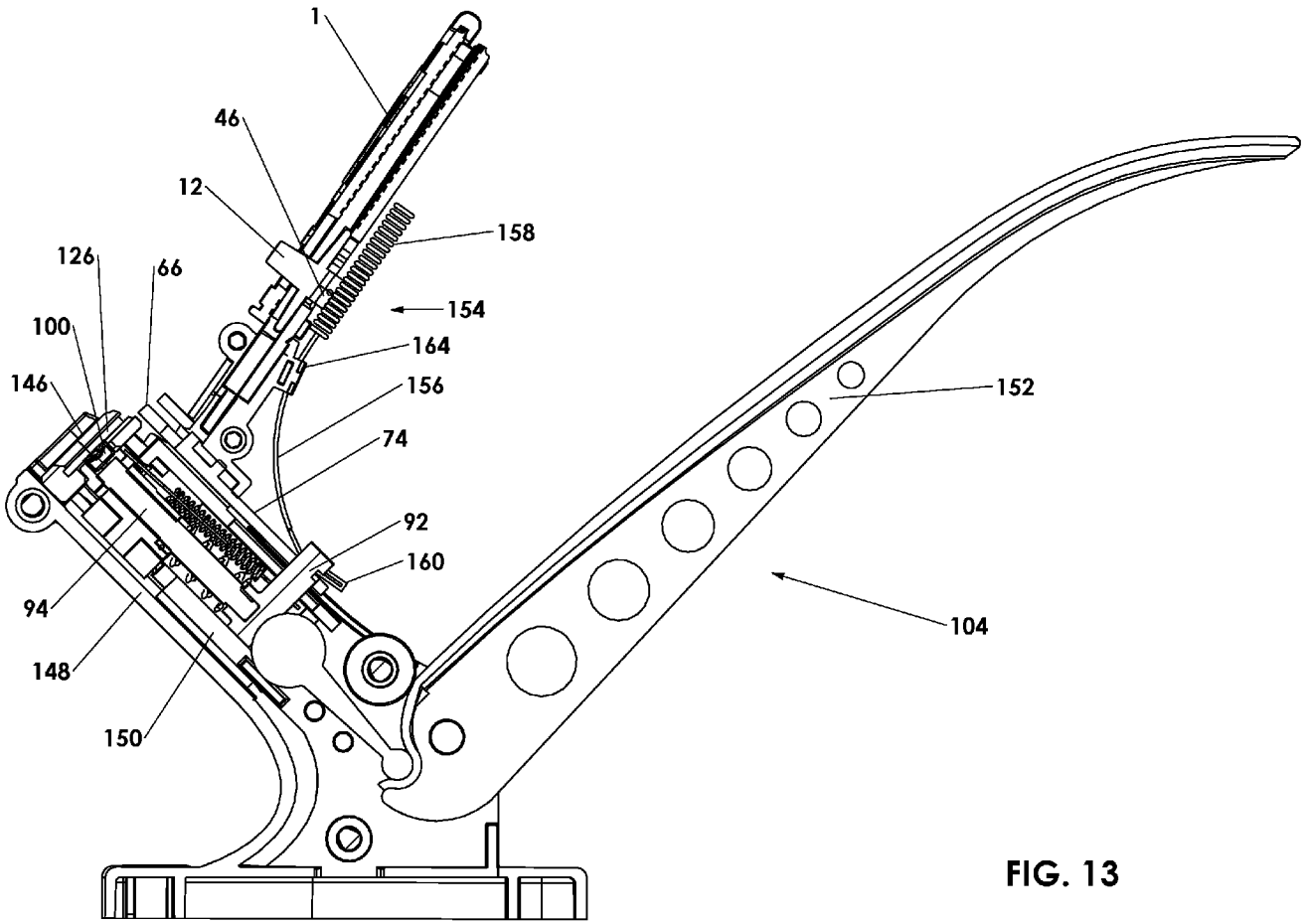
FIG. 13 is a cross sectional view of a removable folding primer tray retained in a feed adapter and the feed adapter retained in a bench mounted primer actuator in accordance with the present invention.

With reference to FIG. 7, cross sectional view of a feed adapter 66 is shown. The feed adapter 66 is retained in a hand held primer actuator 102 as shown in FIG. 12, or a bench mounted primer actuator 104 as shown in FIG. 13. The feed adapter 66 receives the primers 100 from the removable folding primer tray 1 and the feed adapter 66 lifts the primers 100 for pressing into a cartridge (not shown). With reference to FIGS. 8 and 10, the feed adapter 66 preferably includes a first shell half 68, a second shell half 70, a primer press device 72 and a feed elevator 74. The first and second shell halves 68, 70 preferably include a press pin channel 76, a vertical elevator slot 78 and a feed channel receiver 80. The first shell half 68 includes a pivot tongue 82, which extends from an end opposite the feed channel receiver 80. The second shell half 70 includes a pivot slot extension 84, which extends from an end opposite the feed channel receiver 80. The first and second shell halves 68, 70 are assembled to each other by insertion the pivot tongue 82 into a tongue opening 85 in the pivot slot extension 84 and securing the feed channel receivers 80 ends to each other with at least one fastener 86 in at least one pair of fastener holes 88. The vertical elevator slot 78 is located, adjacent the press pin channel 76. The feed channel receiver 80 extends outward from a top of the vertical elevator slot 78. A portion of the primer press device 72 is retained in the press pin channel 76 and a projection slot 90.

Figure 9:
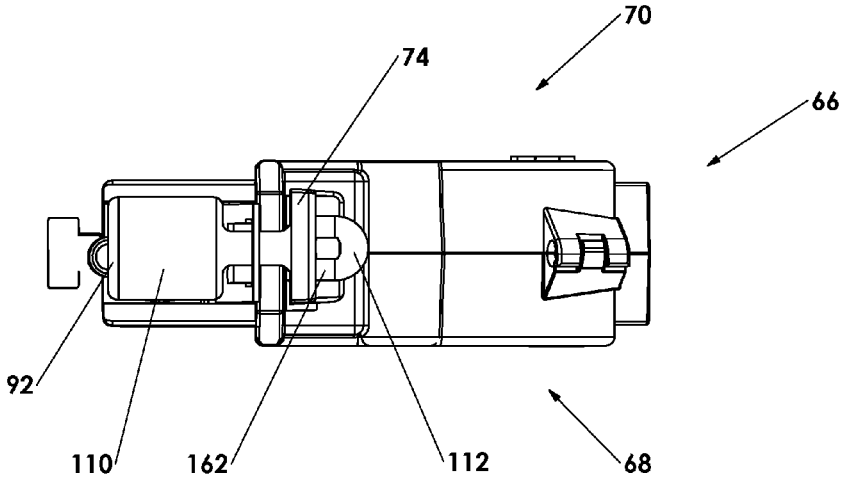
FIG. 9 is a bottom view of a feed adapter for use with a removable folding primer tray and a primer actuator in accordance with the present invention.
Figure 11:
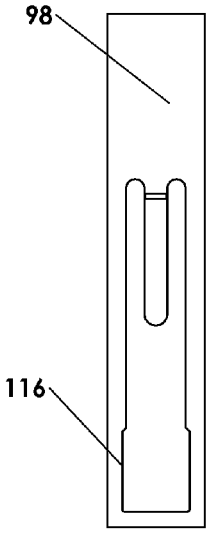
FIG. 11 is a front view of a sliding blast door of a feed adapter of a removable folding primer tray in accordance with the present invention.

With reference to FIGS. 9 and 11, the primer press device 72 preferably includes an anvil base 92, a press pin 94, a press pin return spring 96 and a sliding blast door 98. The anvil base 92 includes a contact portion 110 and an elevator projection 112. The elevator projection 112 extends from a side of the contact portion 110. A press pin bore 114 is formed in a top of the contact portion 110 for retention of the press pin 94. An inner perimeter of the press pin return spring 96 is retained on the press pin 94. The sliding blast door 98 includes a lengthwise slot 116 formed through substantially all of a length of thereof. With reference to FIG. 7, a blast door slot 117 is formed through a top of the first and second shell halves 68, 70 to slidably receive a top of the sliding blast door 98. The elevator projection 112 is inserted through a bottom of the lengthwise slot 116. A blast door compression spring 118 is compressed and inserted between the elevator projection 112 and a top of the lengthwise slot 116.

The feed elevator 74 is slidably retained in the vertical elevator slot 78 in the first and second shell halves 68, 70. The feed elevator 74 includes an elongated plate 119. An elevator projection slot 120 is formed through one end of the elongated plate 119 and a primer slot 122 is formed through an opposing end of thereof. A retention projection 124 extends outward from the elongated plate 119, adjacent the primer slot 122. The projection slot 120 is sized to receive the elevator projection 112 of the anvil portion 92. The primer slot 122 is sized to receive the primer 100 dispensed from the removable folding primer tray 1. With reference to FIGS. 7-10, a top of the sliding blast door 98 covers an open channel to the primer slot 122 of the feed elevator 74, when the primer 100 is elevated for pressing into a shell (not shown).

The feed channel receiver 80 includes a channel receiver slot 125, which communicates with a primer channel 127. The channel receiver slot 125 is sized to receive the feed channel 18. The primer channel 127 is sized to slidably receive a cross section of the primer 100.

The primer actuator may be hand held or bench mounted. Lee Precision of Hartford, Wis. manufacturers a suitable hand held primer actuator, under the product names of New Auto Prime and Lee Ergo Prime. The bench mounted primer actuator is sold under a product name of Auto Bench Prime. The hand held primer actuators are preferably assembled in the following manner such as item 102. With reference to FIG. 12, a shell holder insert 126 is slid into a shell holder slot 128 of the hand held primer actuator 102. The feed adapter 66 is slid into a channel 132 of a tray retaining body 130. The anvil base 92 of the feed adapter 66 is slid upward. A thumb operated actuator body 134 includes a thumb lever 136 and a connecting rod 138. The connecting rod 138 includes a first pivot end 140 and a second pivot end 142. The first pivot end 140 is pivotally engaged with the thumb lever 136. The second pivot end 142 is pivotally engaged with a bottom of the contact portion 110 of the anvil base 92. A curved cavity 144 is formed in a bottom of the contact portion 110 to receive the second pivot end 142 of the connecting rod 138. Squeezing the thumb lever 136 causes upward axial movement of the anvil base 92, which also causes the press pin 94, the feed elevator 74 and the sliding blast door 98 to move upward. An end of the press pin 94 presses the primer 100 into a shell.

With reference to FIG. 13, the shell holder insert 126 is slid into a shell holder slot 146 of the bench mount primer actuator 104. The feed adapter 66 is slid into a channel 150 of a tray retaining body 148. The anvil base 92 of the feed adapter 66 is slid upward. The connecting rod 138 is inserted between a bottom of an actuation handle 152 and the curved cavity 144 of the feed adapter 66. Pulling down the actuation handle 152 causes upward axial movement of the anvil base 92, which also causes the press pin 94, the feed elevator 74 and the sliding blast door 98 to move upward. An end of the press pin 94 presses the primer 100 into a shell.

When using the bench mounted primer actuator 104, an agitation spring 154 must also be used to stimulate downward movement of primers 100 in the removable folding primer tray 1. The agitation spring 154 preferably includes a flexible rod member 156, a coiled portion 158 and a loop end 160. The coiled portion 158 is formed on one end of the flexible rod member 156 and the loop end 160 is formed on an opposing end of the flexible rod member 156. With reference to FIG. 9, the loop end 160 is retained in a spring slot 162 formed through the elevator projection 112. A spring retainer 164 extends downward from the feed channel receiver 80 of the first and second shell halves 68, 70. The spring retainer 164 includes a rod slot 165 for retaining the flexible rod member 156. With reference to FIG. 4, a coil cavity 166 is formed between the pair of opposing snaps 46 and is sized to receive the coiled portion 158. Upward movement of the elevator projection 112 during actuation of the primer 100 causes the coil portion 158 to wiggle the valve switch 12, which causes primers 100 to slide downward in the tray portion 14.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A removable one piece folding primer feeding tray for feeding a plurality of primers into a feed adapter, the feed adapter is retained in a primer actuator and feeds the plurality of primers into the primer actuator, comprising:

a feed tray includes a tray portion, a cover portion, a lengthwise strip and a feed channel, said tray portion includes a tray edge, a first living hinge joins said tray edge to a first edge of said lengthwise strip, said cover portion includes a cover edge, a second living hinge joins said cover edge to a second edge of said lengthwise strip, wherein said tray portion pivots relative to said lengthwise strip, said cover portion pivots relative to said lengthwise strip, said feed channel extends from an opposing edge of said tray portion.

2. The removable one piece folding primer feeding tray of claim 1 wherein:

a valve switch is slidably engaged with said tray portion, wherein said valve switch includes a dispense position and a non-dispense position, the plurality of primers are dispensed through said feed channel when said valve switch is in said dispense position, the plurality of primers are retained in said feed tray when said valve switch is in said non-dispense position.

3. The removable one piece folding primer feeding tray of claim 1 wherein:

an inner perimeter of said feed tray is created by two opposing tray side walls of said tray portion and two opposing cover side walls of said cover portion, said feed tray is sized to receive an outer perimeter of a box of primers.

4. The removable one piece folding primer feeding tray of claim 2 wherein:

said valve switch includes a tray sliding retainer, a base portion and a cover sliding retainer, said tray sliding retainer extends downward from a bottom of said base portion, said tray sliding retainer is slidably engaged with a switch slot in said tray portion, said cover sliding retainer extends upward from a top of said base portion, said cover sliding retainer is capable of retaining said cover portion against said tray portion.

5. The removable one piece folding primer feeding tray of claim 1 wherein:

a plurality of concentric circular projections extend upward from said tray portion, a height of said plurality of said concentric circular projections is less than a fifth of a height of a thickness of a primer.

6. A removable one piece folding primer feeding tray for feeding a plurality of primers into a feed adapter, the feed adapter is retained in a primer actuator and feeds the plurality of primers into the primer actuator, comprising:

a feed tray includes a tray portion, a cover portion, a lengthwise strip and a feed channel, said tray portion includes a tray edge, said tray edge is joined to a first edge of said lengthwise strip with a plurality of first bend tabs, said cover portion includes a cover edge, a second edge of said lengthwise strip is joined to said cover edge with a plurality of second bend tabs, wherein said tray portion pivots relative to said lengthwise strip, said cover portion pivots relative to said lengthwise strip, said feed channel extends from an opposing edge of said tray portion, said feed channel communicates with an inner perimeter of said tray portion.

7. The removable one piece folding primer feeding tray of claim 6 wherein:

a valve switch is slidable engaged with said tray portion, wherein said valve switch includes a dispense position and a non-dispense position, said cover portion being locked to said feed tray when said valve switch is in said dispense position, the plurality of primers being dispensed through said feed channel when said valve switch is in said dispense position, the plurality of primers being retained in said feed tray when said valve switch is in said non-dispense position.

8. The removable one piece folding primer feeding tray of claim 6 wherein:

an inner perimeter of said feed tray is created by two opposing tray side walls of said tray portion and two opposing cover side walls of said cover portion, said feed tray is sized to receive an outer perimeter of a box of primers.

9. The removable one piece folding primer feeding tray of claim 7 wherein:

said valve switch includes a tray sliding retainer, a base portion and a cover sliding retainer, said tray sliding retainer extends downward from a bottom of said base portion, said tray sliding retainer is slidably engaged with a switch slot in said tray portion, said cover sliding retainer extends upward from a top of said base portion, said cover sliding retainer is capable of retaining said cover portion against said tray portion.

10. The removable one piece folding primer feeding tray of claim 6 wherein:

a plurality of concentric circular projections extend upward from said tray portion, a height of said plurality of said concentric circular projections is less than a fifth of a height of a thickness of a primer.

11. The removable one piece folding primer feeding tray of claim 6 wherein:

said removable one piece folding primer feeding tray having a substantially triangular shape in a locked position.

12. A removable one piece folding primer feeding tray for feeding a plurality of primers into a feed adapter, the feed adapter is retained in a primer actuator and feeds the plurality of primers into the primer actuator, comprising:

a feed tray includes a tray portion, a cover portion, a lengthwise strip and a feed channel, said tray portion includes a tray edge, a first living hinge joins said tray edge to a first edge of said lengthwise strip, said cover portion includes a cover edge, a second living hinge joins said cover edge to a second edge of said lengthwise strip, wherein said tray portion pivots relative to said lengthwise strip, said cover portion pivots relative to said lengthwise strip, said feed channel extends from an opposing edge of said tray portion, said feed channel communicates with an inner perimeter of said tray portion, wherein said feed channel communicates with the feed adapter.

13. The removable one piece folding primer feeding tray of claim 12 wherein:

a plurality of sight windows are formed adjacent said feed channel for viewing of some of said plurality of primers.

14. The removable one piece folding primer feeding tray of claim 12 wherein:

a valve switch is slidable engaged with said tray portion, wherein said valve switch includes a dispense position and a non-dispense position, the plurality of primers being dispensed through said feed channel when said valve switch is in said dispense position, the plurality of primers being retained in said feed tray when said valve switch is in said non-dispense position.

15. The removable one piece folding primer feeding tray of claim 14 wherein:

said valve switch includes a tray sliding retainer, a base portion and a cover sliding retainer, said tray sliding retainer extends downward from a bottom of said base portion, said tray sliding retainer is slidably engaged with a switch slot in said tray portion, said cover sliding retainer extends upward from a top of said base portion, said cover sliding retainer is capable of retaining said cover portion against said tray portion.

* * * * *